US011365593B1

(12) United States Patent
Cordova et al.

(10) Patent No.: US 11,365,593 B1
(45) Date of Patent: Jun. 21, 2022

(54) VACUUM DEVICE AND VACUUM ASSISTED DIGGER SYSTEM

(71) Applicant: Factory Direct Fastening, Inc., North Hollywood, CA (US)

(72) Inventors: Carlos Cordova, North Hollywood, CA (US); Sammy Vargas, North Hollywood, CA (US)

(73) Assignee: Factory Direct Fastening, Inc., North Hollywood (CA)

( * ) Notice: Subject to any disclaimer, the term of this patent is extended or adjusted under 35 U.S.C. 154(b) by 0 days.

(21) Appl. No.: 17/370,890

(22) Filed: Jul. 8, 2021

(51) Int. Cl.
*E21B 21/01* (2006.01)
*E21B 21/16* (2006.01)
*E21B 7/02* (2006.01)

(52) U.S. Cl.
CPC ..... *E21B 21/011* (2020.05); *E21B 7/028* (2013.01); *E21B 21/16* (2013.01)

(58) Field of Classification Search
CPC ..... E21B 11/005; E02F 3/925; E02F 3/9243; E02F 3/9256; E02F 3/9275; E02F 3/9268; E02F 3/90; Y10S 37/905; E02D 2250/0053
See application file for complete search history.

(56) References Cited

U.S. PATENT DOCUMENTS 3,127,629 A * 4/1964 Miller, Jr. ..... A47L 5/38 15/314
4,580,309 A * 4/1986 Ogden ..... A47L 11/34 15/422.2
5,535,836 A * 7/1996 Cagianut ..... E21B 21/00 405/269
5,618,410 A * 4/1997 Wallace ..... A47L 7/0038 210/123
5,623,744 A * 4/1997 Triplett ..... A47L 5/365 15/422.2
5,948,127 A * 9/1999 Minakawa ..... B01D 46/58 55/284
6,381,803 B1 * 5/2002 Berfield ..... A47L 5/22 15/422.2
6,471,751 B1 * 10/2002 Semanderes ..... B01D 46/76 95/271

(Continued)

*Primary Examiner* — Kipp C Wallace
(74) *Attorney, Agent, or Firm* — McConnell Law Firm, P.C.; Robert McConnell

(57) ABSTRACT

An improved vacuum device for use with a vacuum assisted post hole digger tool. The improved vacuum device includes two suction providing motors with their suction outlets connected in a parallel fashion directly to a filter box. The dual motor configuration provides significantly improved suction power over existing vacuum devices but is still able to be powered on household 120V AC power.

The improved vacuum device is paired with a post hole digger apparatus which includes an elongated hollow tubular tool for transmitting vacuum to the base end of the tube. The base end of the tube further comprises a variety bore heads for breaking up soil. A variety of devices for breaking up soil or removing clogs around the bore head are included: a thrasher bar, a hammer bar and an unclogger bar. Each of these devices are designed to be activated either manually by the user by application of force at the upper end of the tool or by application of rotary force by a motor disposed at the top of the housing.

14 Claims, 16 Drawing Sheets

(56) References Cited

U.S. PATENT DOCUMENTS

| | | | | |
|---|---|---|---|---|
| 7,185,720 | B1 * | 3/2007 | Menna | E21B 11/005 175/209 |
| 9,303,370 | B1 * | 4/2016 | Hershberger | E01C 21/00 |
| 9,556,692 | B1 * | 1/2017 | Cordova | E21B 11/005 |
| 10,590,713 | B1 * | 3/2020 | Puppel | E21B 3/025 |
| 2012/0151710 | A1 * | 6/2012 | Yarbrough | A47L 9/20 15/347 |

* cited by examiner

FRONT VIEW

TOP VIEW

SIDE VIEW

SIDE VIEW

BOTTOM VIEW

VACUUM DEVICE AND VACUUM ASSISTED DIGGER SYSTEM

BACKGROUND OF THE INVENTION

Field of the Invention

The present invention relates an improved vacuum device to be used with tools for making bore holes such as post holes into soil beneath the surface of the ground. Specifically, the present invention includes a more powerful vacuum device enabled by a novel configuration of vacuum suction fan motors. Because of the novel motor configuration, this improved vacuum device provides more powerful vacuum suction force than other available canister/"Shop-Vac" devices that utilize household 110V AC current. This improved vacuum device, combined with various post hole digger tools utilizing boring heads to sever soil and remove such severed soil by vacuum provide improved post hole digging capability. The present invention includes features such as powered and manual devices for breaking up soil such as a thrasher bar, a hammer bar and various configurations of unclogging bars. This powerful vacuum device and improved soil cutting and removal capabilities improve the digging time and effort needed to create post holes and other round shaped holes in soil and/or mud.

Description of Background Art

The present invention relates to a vacuum powered post hole digging apparatus. Applicant holds patents previously issued in this art, specifically U.S. Pat. No. 8,944,187 titled "Vacuum Assisted Post Hole Digger Tool and Apparatus with Rotary Clog Breaker" and U.S. Pat. No. 9,556,692 also titled "Vacuum Assisted Post Hole Digger Tool and Apparatus with Rotary Clog Breaker." These patents provide novel vacuum powered post hole digger tools and are incorporated by reference.

The present invention relates primarily to an improved vacuum device to be used with such post hole digger tools. The above-mentioned patents are to be used with a vacuum device that removes soil severed or broken by the included bore heads. While applicant's prior patents can be utilized with any vacuum source, the preferred embodiment uses a canister type wet-dry or "Shop-Vac" type vacuum. This type of vacuum device typically includes a round shaped canister with an open top as a base that also serves as a receptacle for materials collected by the device. An airtight cover typically covers the open top of the canister and includes the mechanical elements of such a vacuum device. The cover typically includes two inlets, an external vacuum inlet that collects materials from the vacuum hose and a motor suction inlet from the motor creating the suction. The suction created by the motor is generally filtered through an air filter designed to prevent debris from entering the fan blades of the motor. A flexible vacuum hose is attached to the external vacuum inlet and provides the external suction to collect debris. Typically, these types of vacuum devices include one motor and run on 120V AC household current. The suction power of such vacuums is limited by the size of the electric suction motor. The dual motor configuration of the present invention provides much improved suction performance over prior art configurations.

OBJECTS OF THE INVENTION

It is an object of the invention to provide an improved vacuum device for use with post hole digger apparatuses.

It is an object of the invention to provide an improved vacuum device with dual suction motors configured in a parallel configuration providing improved suction performance.

It is an object of the invention to provide an improved vacuum device that provides improved suction performance and is powered by 120V AC household electric power.

It is an object of the invention to provide a vacuum assisted post hole digger apparatus for boring post holes in soil for use with the improved vacuum device.

It is an object of the invention to provide a vacuum assisted post hole digger apparatus for boring post holes in soil that includes a thresher bar for breaking up soil.

It is an object of the invention to provide a vacuum assisted post hole digger apparatus for boring post holes in soil that includes a hammer bar for breaking up soil.

It is an object of the invention to provide a vacuum assisted post hole digger apparatus for boring post holes in soil that includes an unclogging bar for removing mud and soil clogs.

It is an object of the invention to provide a vacuum assisted post hole digger apparatus for boring post holes in soil that includes a hammer bar for breaking up soil.

It is an object of the invention to provide a vacuum assisted post hole digger apparatus for boring post holes in soil that includes both manual operation and powered operation of the thresher bar, hammer bar and unclogging bar.

It is an object of the invention to provide a vacuum assisted post hole digger apparatus for boring post holes in soil that a variety of boring head configurations.

Various other objects and advantages of the present invention, and its most novel features, will become apparent to those skilled in the art by perusing the accompanying specification, drawings and claims.

SUMMARY OF THE INVENTION

The present invention relates to an improved vacuum device for use with a vacuum assisted post hole digger tool. The post hole digger is an apparatus for boring relatively deep, longitudinally elongated holes such as post holes into soil. The improved vacuum device is similar in design to existing canister, wet-dry or "Shop-Vac" type vacuums but includes a novel improvement that provides improved suction performance while still being able to utilize household 120V AC electrical power. The novel configuration includes two suction providing motors with their suction outlets connected in a parallel fashion directly to a filter box. The dual motor configuration provides significantly improved suction power over existing vacuum devices but is still able to be powered on household 120V AC power.

The improved vacuum device is paired with a post hole digger apparatus which includes an elongated hollow tubular tool housing comprising two ends, the first end connected to the improved vacuum device via a flexible tube and the second end comprising a vacuum inlet at the base of the apparatus. The second end, at the base of the apparatus, further comprises a bore head for breaking up soil. Once the soil is broken up, the vacuum device removes it via suction to the attached canister. The improved performance of the vacuum device provides much improved performance over previous vacuum configurations utilizing standard canister/wet-dry vacuums.

The present invention also includes multiple configurations of bore heads. The post hole digger tool according to the present invention includes a pair of transversely aligned cylindrically-shaped turnstile-type handles which protrude perpendicularly outwards form opposite sides of the tubular housing. The handles are located in a horizontal plane a short distance below the upper transverse end of the housing below the vacuum inlet coupler tube.

The present invention further includes a variety of devices for breaking up soil or removing clogs around the bore head. These devices each are disposed down the hollow housing from the upper end of the tool to the base. They have different shapes for different tasks including a thrasher bar, a hammer bar and an unclogger bar. Each of these devices are designed to be activated either manually by the user by application of force at the upper end of the tool or by application of rotary force by a motor disposed at the top of the housing.

DETAILED DESCRIPTION OF THE INVENTION

The present invention relates to a vacuum powered post hole digger tool for digging generally circular holes in the earth. The system comprises two main elements: 1) an improved vacuum device and 2) a vacuum assisted post hole digger tool. In the preferred embodiment, the vacuum device is similar in shape to a canister, wet-dry or a "Shop Vac" type vacuum. The improved vacuum device utilizes a novel two motor configuration that provides increased suction while being able to be powered by standard 120 volt AC household power. The post hole digger tool is a vertical tubular device with a cutting head and suction outlet at one end and a suction connection to the improved vacuum device at the other end. The post hole digger tool further includes an opening at the top of the tubular connection for insertion of two unclogger bars for removing clogs at the cutting head. In an alternate preferred embodiment, the cutting head includes air gaps around the head to allow suction to escape the head and prevent clogging.

Figure 1:
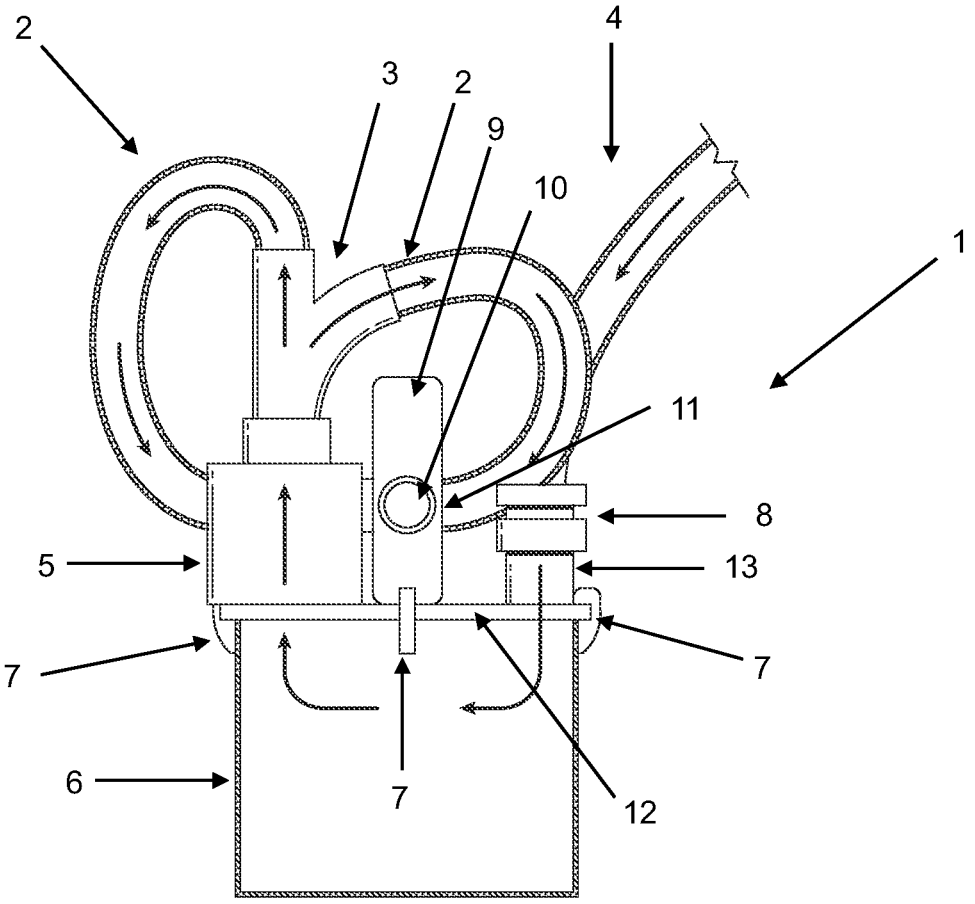
FIG. 1 shows a front view of the improved vacuum device.

FIG. 1 is a front view of the improved vacuum device 1. In the preferred embodiment shown, dual vacuum motors 9 (only one is shown in this view) create suction to drive the vacuum device. The motors are of the electric variety that run on household 120V AC power. The motors are matched in power, with each motor drawing up to 6.5 AMPs of power. The motors in the preferred embodiment are Ridgid Model HD 16000 electric motors. While these motors are the preferred embodiment, any suitable alternative motor could be utilized, including powered by electric (120V or 220V), gas or any other suitable power source known in the art. The combination of the dual motors can create air flow of up to 170 CFM (cubic feet per minute) rather than 58 CFM for a standard one motor vacuum device. Each motor 9 comprises a suction outlet 11 and an exhaust outlet 10. Suction outlet 11 for each motor 9 is connected to an individual vacuum hose 2. Each of the two vacuum hoses 2 connect to a vacuum junction 3 that is attached to a filter box 5, attached to lid 12, and with an airtight fluid connection to the tank 6 of the vacuum device. Vacuum hoses 2 are made of 3" vacuum type hose in the preferred embodiment but could be made of any other suitable airtight and flexible hose material known in the art.

Filter box 5 contains an air filter to prevent any large particles of material to be drawn into the motor. The filter is formed of any suitable vacuum filter known in the art. The preferred embodiment uses a metal reinforced reusable air filter manufactured by McMaster-Carr, Model Number 2072K22. This filter has a MERV rating of 4 and filters particles down to 10 microns in size. Lid 12 sits on tank 6 which collects the matter captured by the vacuum device. In the preferred embodiment, the diameter of the tank 6 and lid 12 is 20" but tanks and lids of any suitable size comport with the claims of the present invention. In the preferred embodiment, tank 6 has a 16.5" vertical height. Lid 12 is secured to tank 6 with latches 7 (in the preferred embodiment, three latches total) that are lockable to provide a secure attachment between lid 12 and tank 6. Main suction hose 4 comprises two ends, with the first connecting to base suction inlet 13 with an airtight fluid connection through lid 12. The first end of main suction hose 4 latches to base suction inlet 13 with cam lock 8 for a secure attachment. The second end of main suction hose 4 connects to the vacuum post hole digger.

Figure 2:
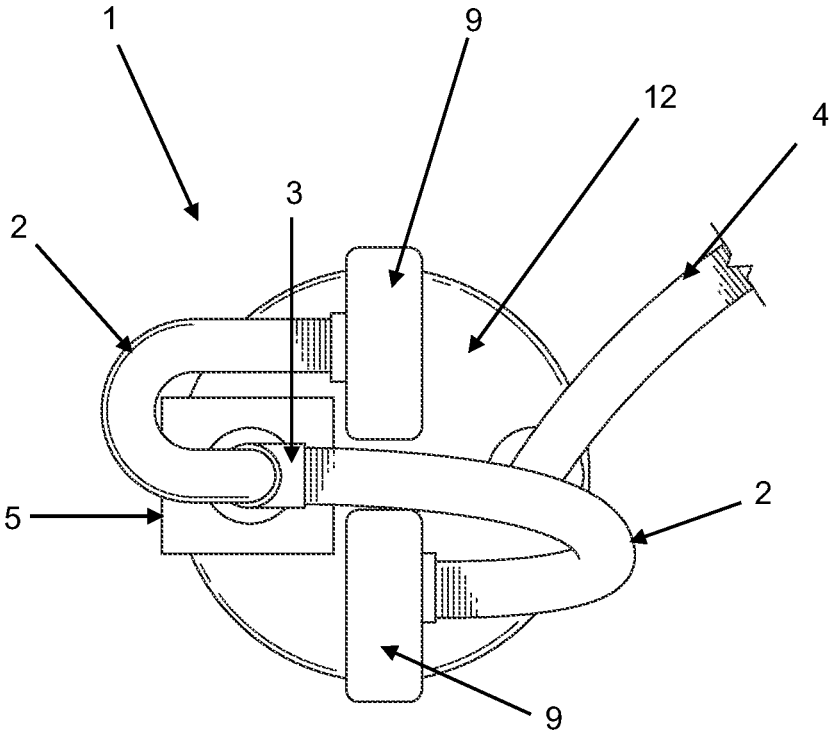
FIG. 2 shows a top view of the improved vacuum device.

FIG. 2 shows a top view of the improved vacuum device 1. First vacuum motor 9 and second vacuum motor 9 are oriented on the lid 12 of the device. First individual vacuum hose 2 is connected to the suction outlet of first vacuum motor 9. Second individual vacuum hose 2 is connected to the suction outlet of first vacuum motor 9. Second individual vacuum hose 2 is connected to the suction outlet of second vacuum motor 9. First individual vacuum hose 2 meets second individual vacuum hose 2 at vacuum junction 3 and is fed into filter box 5. Filter box 5 is disposed on the top of lid 12 and is connected to tank 12 (not shown) via an airtight fluid connection. As described above, filter box 5 contains a vacuum air filter known in the art. The first end of main suction hose 4 latches to base suction inlet 13 with cam lock 8 (not shown) for a secure attachment. The second end of main suction hose 4 connects to the vacuum post hole digger.

Figure 3:
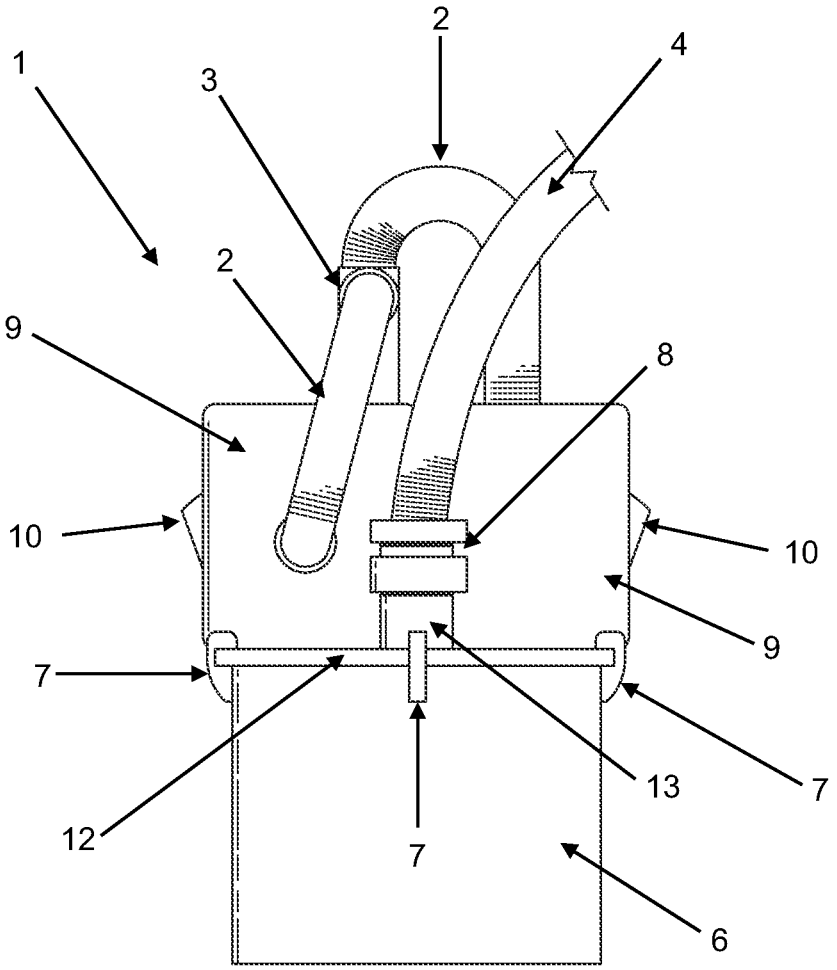
FIG. 3 shows a side view of the improved vacuum device.

FIG. 3 shows a side view of the improved vacuum device 1. First individual vacuum hose 2 is connected to the suction outlet of first vacuum motor 9 and second individual vacuum hose 2 is connected to the suction outlet of second vacuum motor 9. Each vacuum motor 9 has a corresponding exhaust outlet 10. First and second individual vacuum hoses 2 meet in vacuum junction 3 which is connected to filter box 5 (not shown). Filter box 5 is disposed on lid 12 which is positioned on top of tank 6 and connected to tank 6 via an airtight fluid connection. Lid 12 is securely connected to tank 6 with three lockable latches 7. Main suction hose 4 comprises two ends, with the first connecting to base suction inlet 13 with an airtight fluid connection through lid 12. The first end of main suction hose 4 latches to base suction inlet 13 with cam lock 8 for a secure attachment. The second end of main suction hose 4 connects to the vacuum post hole digger.

Figure 4:
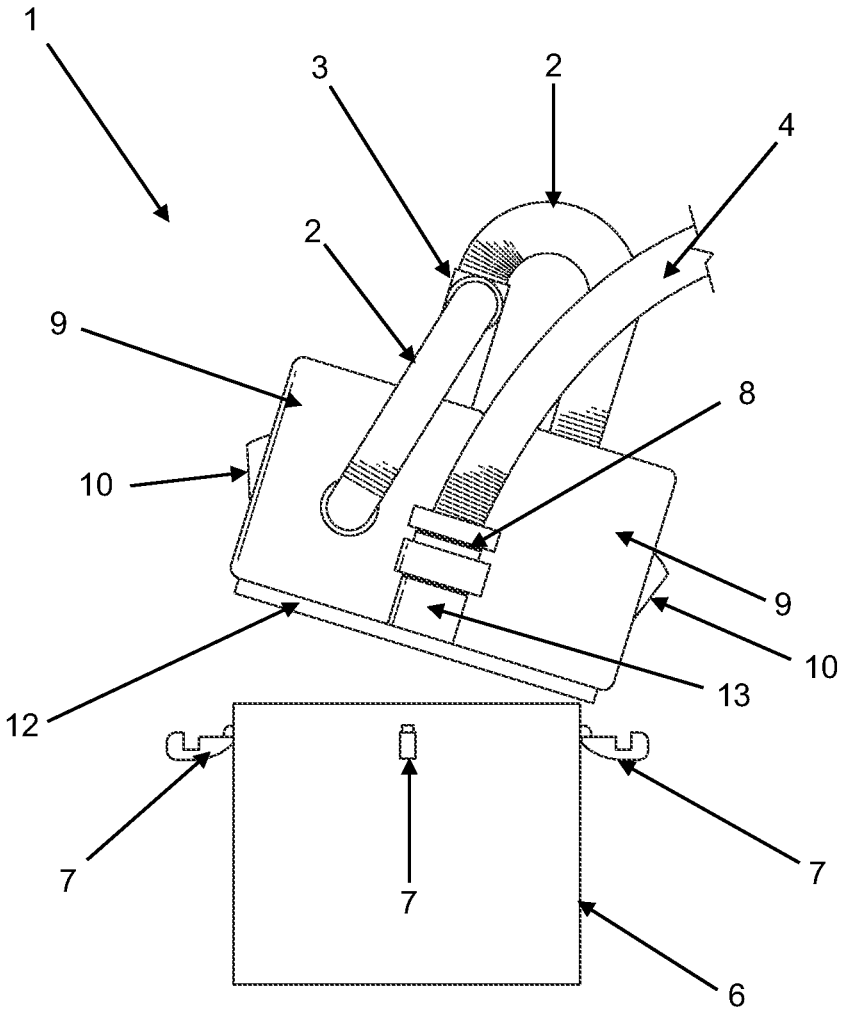
FIG. 4 shows a side view of the improved vacuum device with the lid tipped open.

FIG. 4 shows an alternate side view of the improved vacuum device 1. In this view, latches 7 are unlocked and lid 12 is tipped up from tank 6. Lid 12 with attached vacuum motors 9, filter box 5 and various vacuum hoses can be removed from the tank 6 to allow emptying of collected debris from tank 6 and cleaning of the air filter contained in filter box 5.

Figure 5:
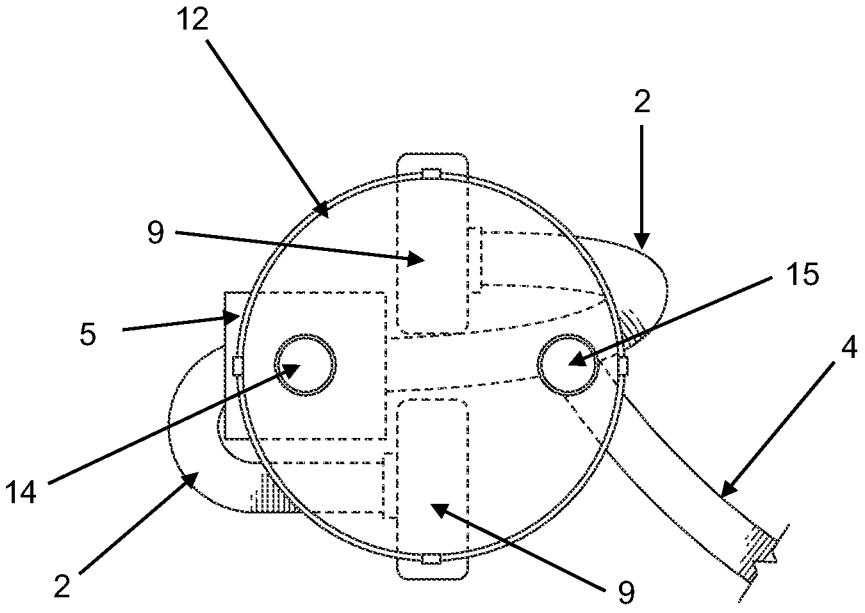
FIG. 5 shows a view of the underside of the lid.

FIG. 5 shows a view of the underside of lid 12. The underside of lid 12 is the portion contained within tank 6. As in prior figures, dual vacuum motors 9 are shown each connected to an individual vacuum hose 2. These individual vacuum hoses 2 meet in a vacuum junction which is in turn connected to filter box 5. Filter box 5 is disposed on top of lid 12 with connection to the inside of the tank 6 via vacuum inlet port 14. Air that passes through vacuum inlet port 14 is filtered via an air filter contained in filter box 5 thus preventing debris from entering the fan blades of the motors. The first end of main suction hose 4 latches to base suction inlet 13 with cam lock 8 for a secure attachment. Main suction hose 4 is connected to the inside of the tank by debris inlet port 15.

Figure 6:
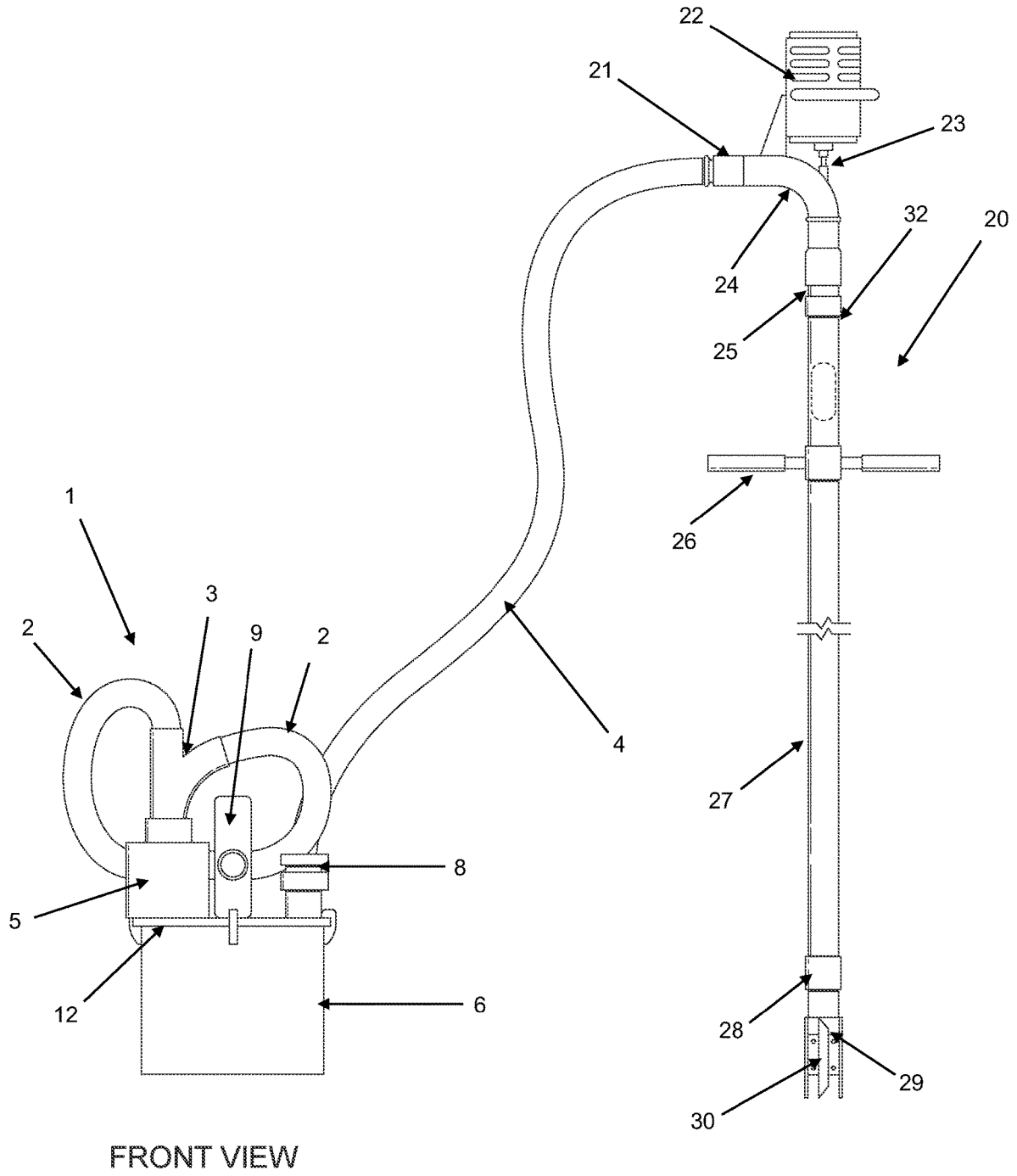
FIG. 6 shows a view of the complete system with improved vacuum device and post hole digger tool.

FIG. 6 shows a view of the complete vacuum powered post hole digger system comprised of the improved vacuum device 1 and vacuum powered post hole digger tool 20. Main suction hose is connected to improved vacuum device 1 and digger vacuum connection 21. Digger vacuum connection 21 allows the vacuum source to be connected to the end of the post hole digger tool 20, which comprises a straight, longitudinally elongated, circular cross-section cylindrical housing 27, which has an airtight fluid connection between digger vacuum connection 21 and digger tool vacuum inlet 30. The rotary motor 22 that powers the various unclogging devices is shown. Handles 26 are connected to housing 27 which allow the user to rotate the device to provide additional digging assistance. Detachable bore head 30 is shown at the end of the housing 27. Each of these items will be described in greater detail in following figures.

Post hole digger tool 20 further includes a vacuum inlet tube 24, which preferably has the shape of a tubular right-angle elbow, that has a lower vertical section and an upper horizontal section which protrudes laterally outwards from the upper end of the vertical section. Post hole digger tool 20 includes a coupler 25 for coaxially coupling the vertical section of vacuum inlet tube 24 in a vacuum connection to the upper open end 32 of tubular housing 27, thus forming a smooth, hermetically sealed passageway between the elongated straight bore of housing 27 and the curved bore 24 of the vacuum inlet elbow.

Figure 7:
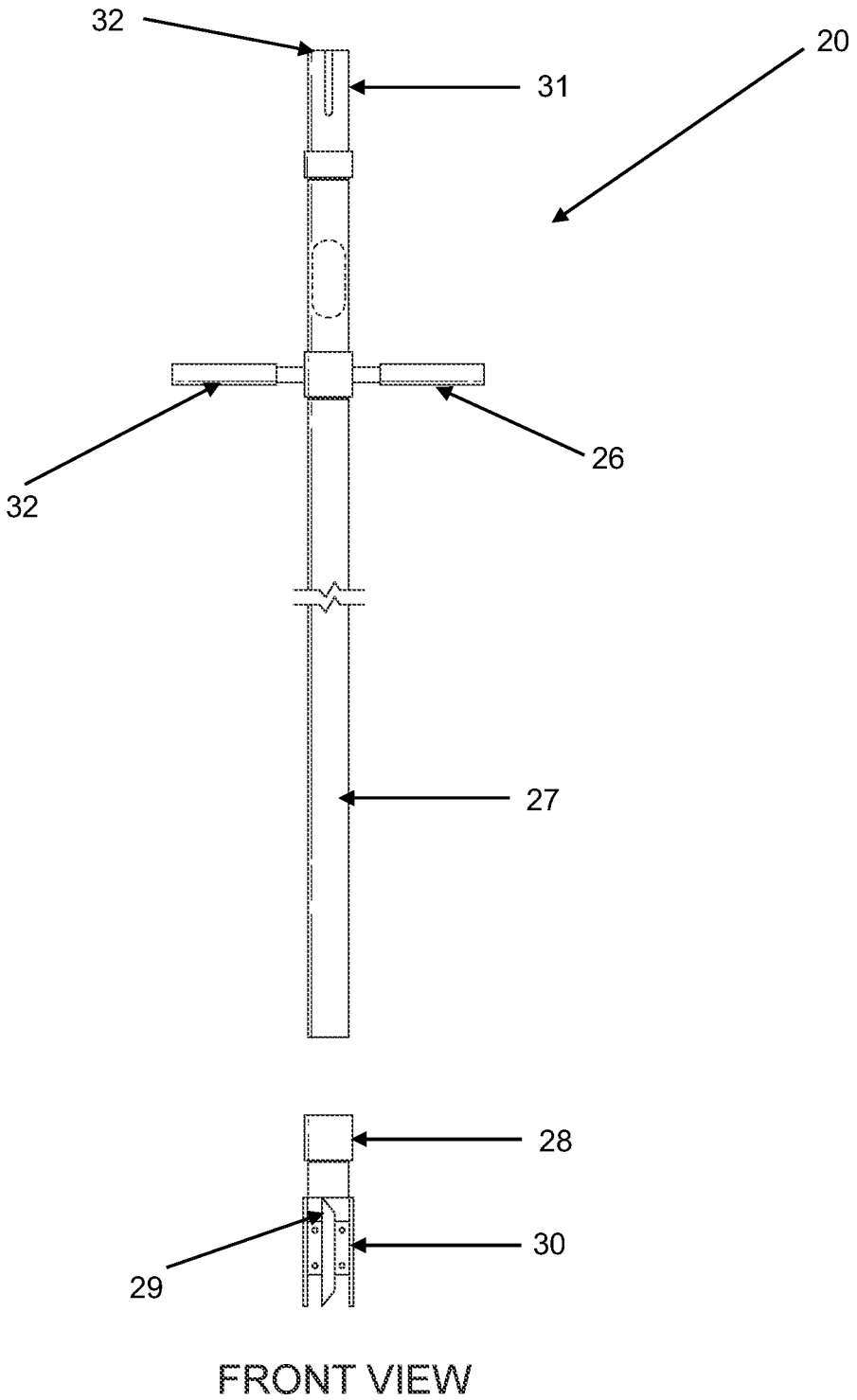
FIG. 7 shows a front view of the post hole digger apparatus.

FIG. 7 shows a view of the housing 27 of the vacuum assisted post hole digger system. Vacuum assisted post hole digger tool 20 includes a straight, longitudinally elongated, circular cross-section cylindrical housing 27, which is made of heavy gauge steel or cast iron. Although the dimensions of housing 27 are not critical, example embodiments of the invention which were tested by the present inventor had outer diameters ranging between about 4 inches to 7 inches, and lengths of about six feet.

Housing 27 of vacuum assisted post hole digger tool 20 has a pair of straight, horizontally oriented left and right handlebars 26, located vertically below the upper end of housing 24. Handlebars 26 are attached to and protrude perpendicularly outwards the housing 24. Preferably, as shown in the figures, handlebars 26 have insulating tubular rubber handle grips 32 fitted over them. Housing 27 of tool 20 has disposed through its length a uniform diameter, circular cross-section bore which has an upper opening 32 and a lower opening 29.

Figure 8:
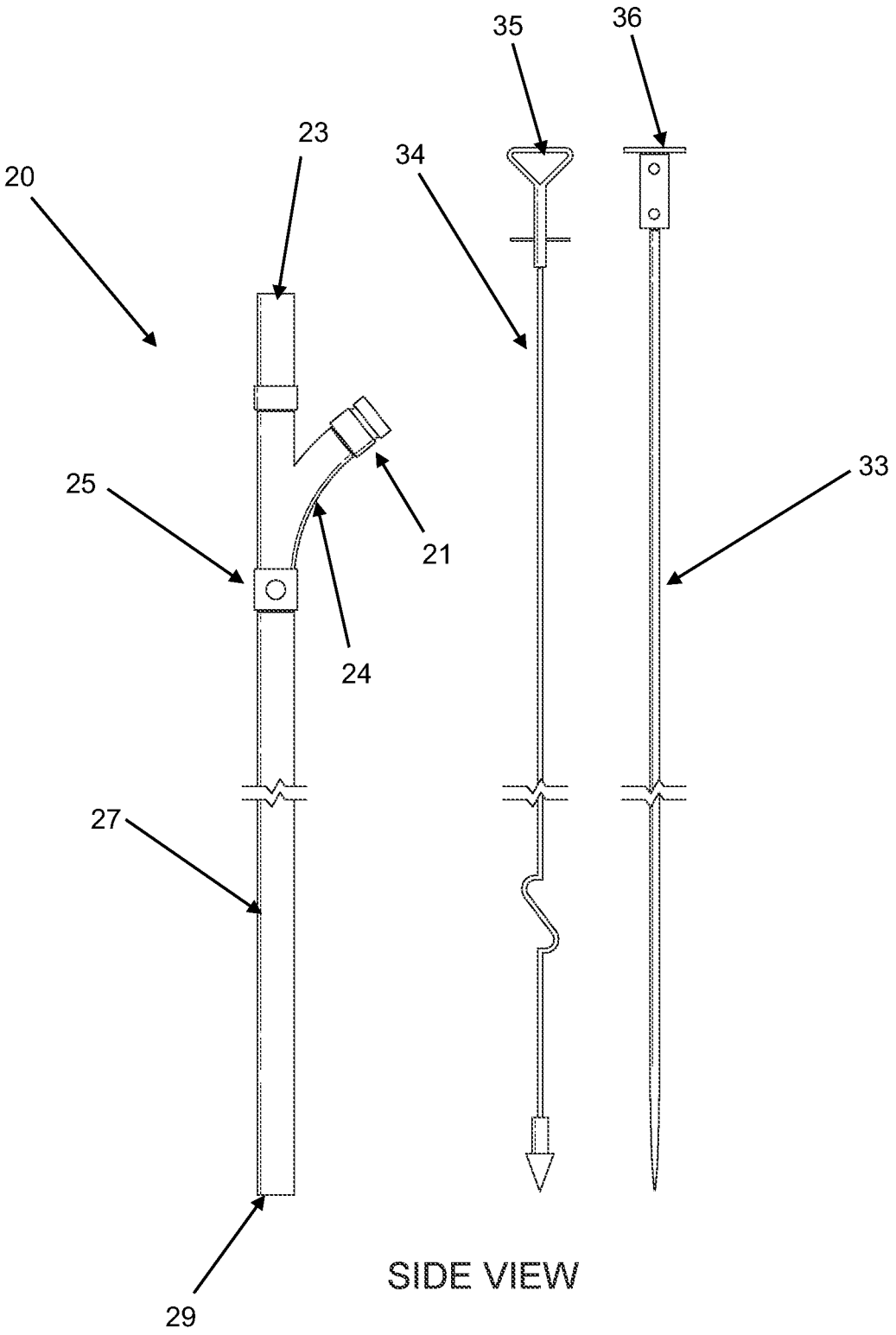
FIG. 8 shows a side view of the post hole digger apparatus, thrasher bar and hammer bar.

FIG. 8 gives a side view of the post hole digger 20 and its various components. Housing 27 is connected to vacuum inlet tube 24 by coupler 25. In this embodiment, vacuum inlet tube 24 is a "y" shaped piece of tubing with one side of the y having digger vacuum connection 21 and the other side of the y having unclogging tool port 23. In this embodiment, the post hole digger is made of 2" tubing, either PVC, steel, or other suitable smooth, rigid material. While this material specification is utilized in this embodiment, any size of tubing, of any suitable smooth and rigid material could be used, depending on the size of the hole to be formed and amount of vacuum available. In this embodiment, the length of the post hole digger from end to end is 68". The digger vacuum connection 21 is made via the directional tubing of vacuum inlet tube 24 and a cam lock head. Also shown in this figure are two variations of unclogger tools suitable for use with post hole digger 20. Unclogging tools allow the user to apply pressure to the ground below the bore head 30 to loosen the material and ease the digging of a post hole. The first type is thrasher tool 34 is utilized for breaking up ground material with a sharp point while providing a twisting motion to the handle disposed at the top. The user applies a horizontal twisting motion to the handle while also providing downward force to break up ground material. The hammer blade attachment 33 allows the user to apply sharp force to the pad 36 at the top of the tool with a hammer. This sharp motion drives the spike shaped opposite end of the tool into the ground material, thus breaking it up more easily.

Figure 9:
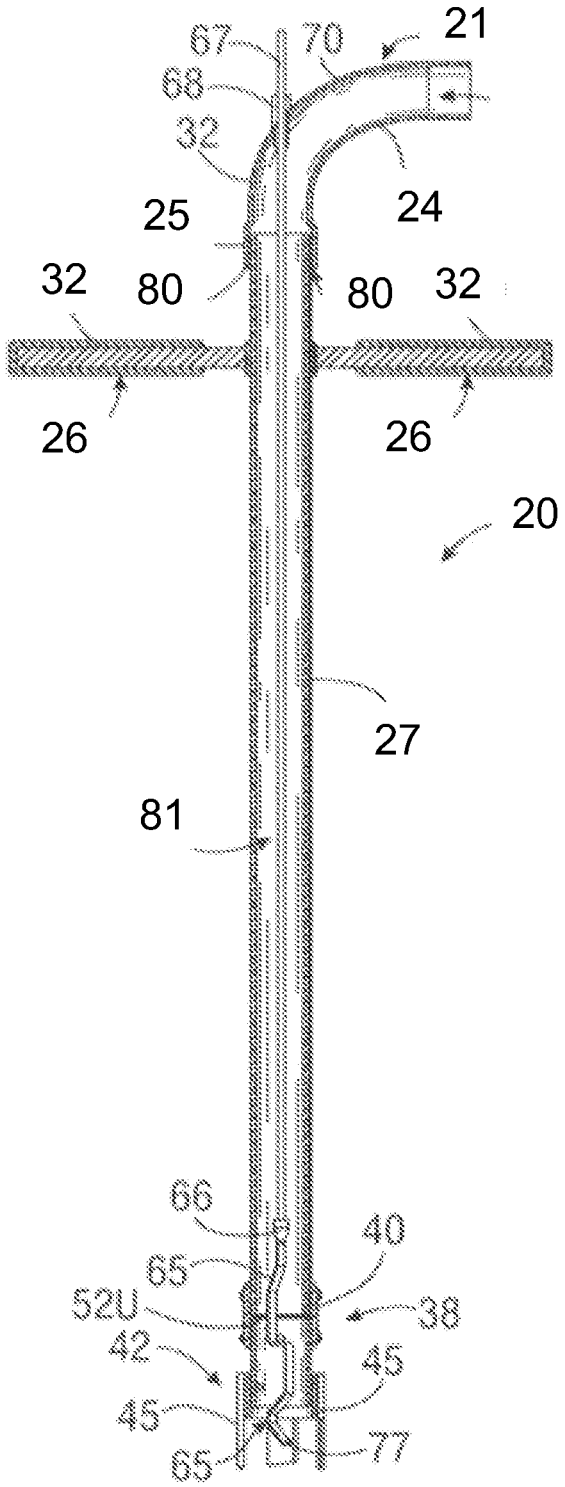
FIG. 9 shows a view of the post hole digger apparatus with the hollow housing and the unclogging bar.

FIG. 9 shows a preferred construction of coupler 80 which includes a lower flange section 36 of vertical section of vacuum inlet coupler 25 that has an enlarged diameter bore that insertably receives the upper end of tubular housing 27. In the preferred embodiment, coupler 80 is a rotary union-type which enables the lateral arm 21 of vacuum inlet tube elbow 24 to be rotated in a horizontal plane relative to the longitudinal axis of tubular housing 27.

Figure 10:
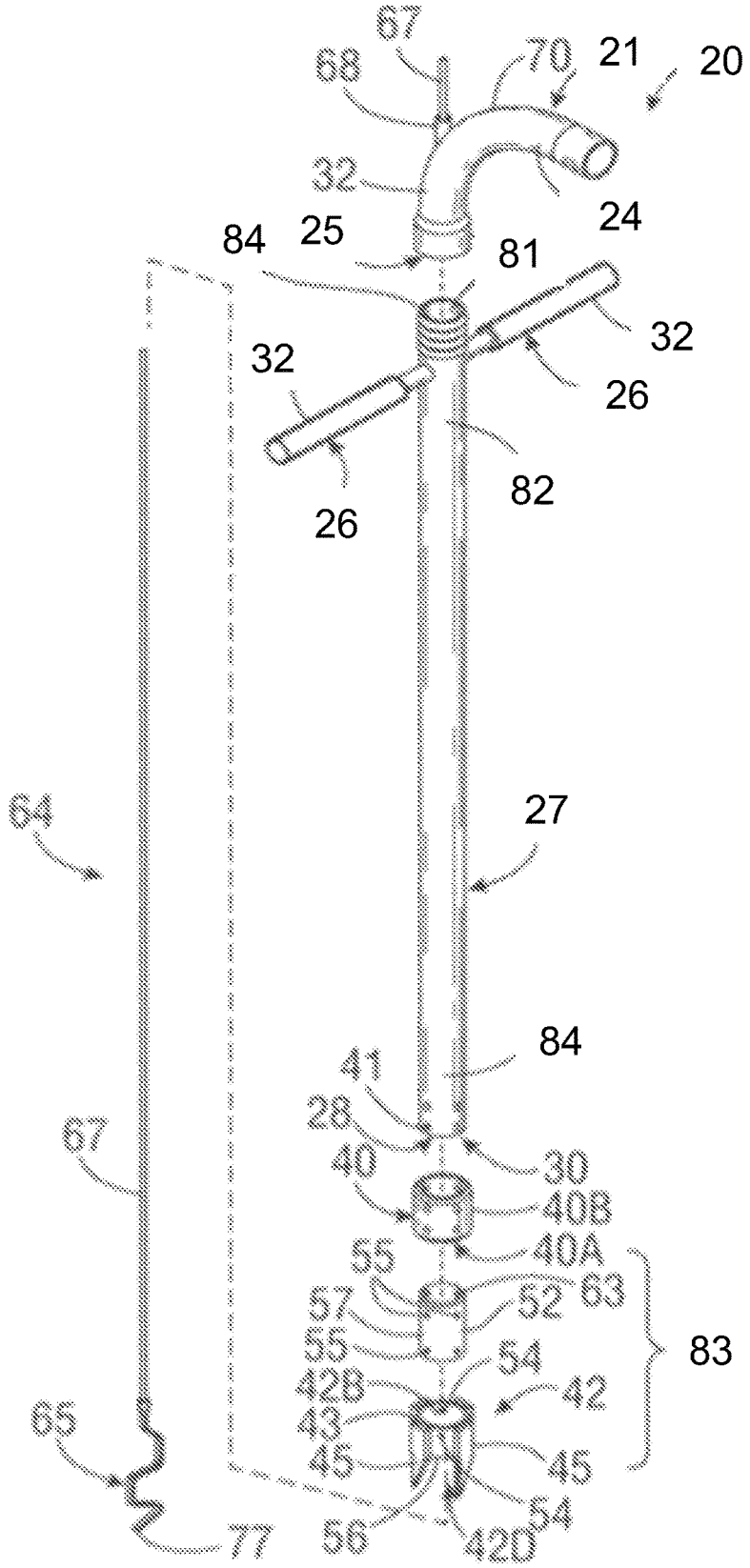
FIG. 10 shows an expanded view of the post hole digger tool with unclogger bar.

FIG. 10 shows that post hole digger tool 20 includes a bore head assembly 83 which is attached to a lower end 84 of tubular housing 24. The bore head assembly 83 includes a cylindrical isolation collar 40 which fits coaxially over the outer circumferential wall 82 of tubular housing 27, and protrudes below the lower transverse end wall 41 of the housing. Isolation collar 40 is made of an electrically insulating material such as heavy rubber and provides electrical isolation between housing 27 and a toothed bore head 42. The function of isolation collar 40 is to prevent an operator of tool 20 from receiving an electrical shock should bore head 42 inadvertently contact a live buried electrical cable, as will be explained below.

Bore head 42 of bore head assembly 83 includes a cylindrically-shaped base ring 43 that has attached to the outer cylindrical wall surface thereof a plurality of wedge-shaped cutting teeth 45. Although the number and spacing of cutting teeth 45 may be varied, in an embodiment of tool 20 bore head 42 had four cutting teeth spaced circumferentially apart at 90-degree intervals.

FIG. 10 further shows that post hole digger tool 20 may optionally include an inner, connector sleeve 52 which is fastened coaxially within base ring 43, as by circumferentially spaced apart bolts 53 disposed radially through aligned holes 54 and 55 through the cylindrical walls of 56, 57, respectively of the base ring 43 and connector sleeve 52 with the lower transverse annular edge wall 59 of the connector sleeve aligned with lower transverse edge wall 59 of the bore head sleeve. Similarly, connector sleeve 52 is fastened at an upper end thereof within bore 40A of isolation collar 40 by bolts 60 disposed radially through aligned holes 61, 62 through the cylindrical wall 40B of isolation collar 40, and aligned holes through connector sleeve 52, located near the upper annular edge wall 63 of the connector sleeve.

Isolation collar 40 is attached to an inner connector sleeve 52 and the lower end of tubular housing 24 in a manner which creates an annular ring-shaped air gap 52U between the upper transverse annular end wall of the sleeve 52 and the lower transverse annular end wall 41 of tubular housing 24. Air gap 52U electrically isolates bore head 42 from tubular housing 24. Bore head 42 has longitudinally through its length a central coaxial bore 42B which preferably has a diameter at least as large as the diameter of bore 82 through housing 27, bore 42B communicating at an upper end with bore 82, and having a lower entrance opening 42D.

FIG. 10 further illustrates the construction of a novel mud and clay unclogger component 64 of the post hole digger tool 20. Mud and clay unclogger 64 includes an elongated is joined at upper end thereof by a coupler collar 66 to an elongated drive shaft 67. Drive shaft 67, which preferably has a round cross-section, is disposed longitudinally upwards through the center of bore 81 through housing 27. The upper end of drive shaft 67 is rotatably mounted in the center of bearing 68 that is fitted into the upper wall 70 of vacuum inlet coupler elbow 24. Bearing 68 is coaxially aligned with the longitudinal center line of housing 24 and forms a vacuum-tight seal with upperwall 69 of elbow 24, so that air cannot leak from the exterior of elbow into the bore 81 through the elbow, when the air pressure in the bore is reduced below ambient atmospheric pressure by coupling the elbow to a vacuum source, such as improved vacuum source 1.

Mud and clay unclogger bar 65 has a zig-zag shape formed by a series of flat sections which angle outwardly and inwardly with respect to the common longitudinal center lines of mud and clay unclogger bar coupler 66 and drive shaft 67, to form a zig-zag shape.

Figure 11:
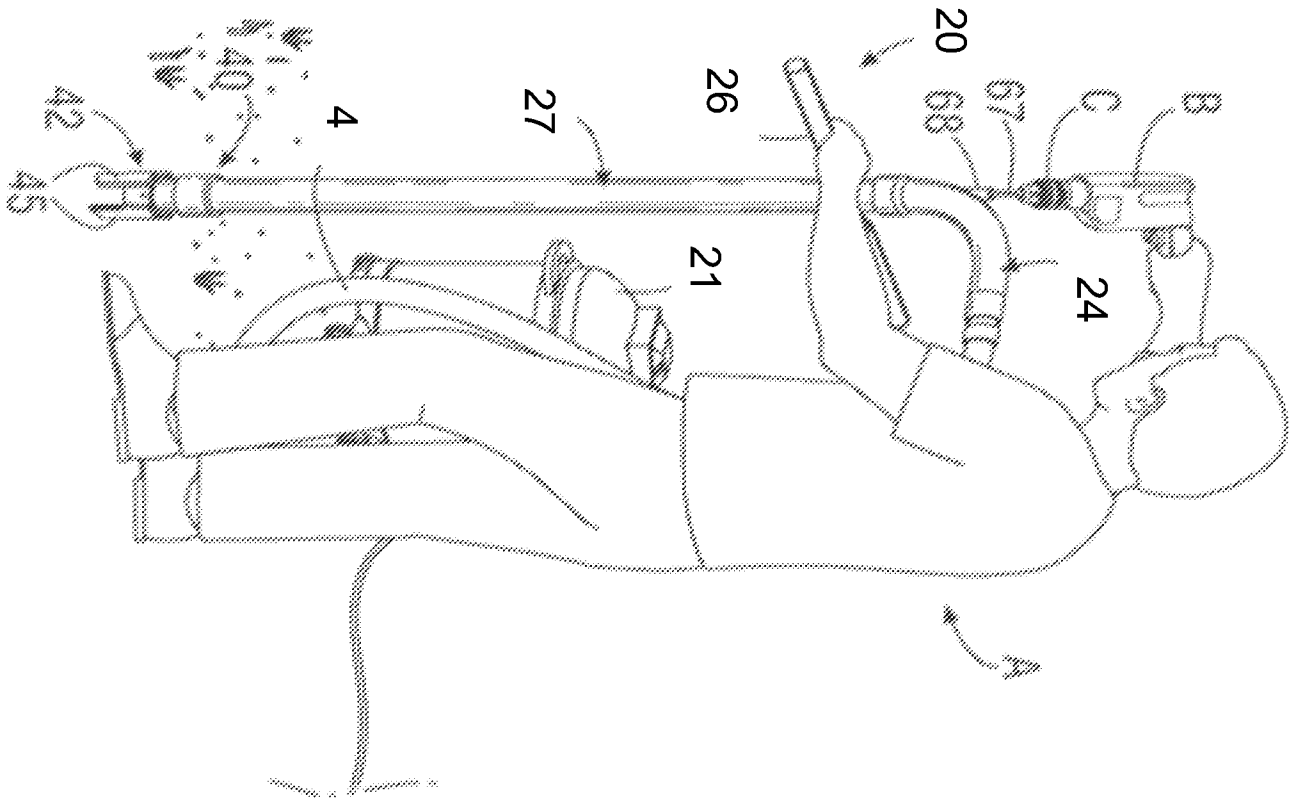
FIG. 11 shows the apparatus in use.

FIG. 11 shows how vacuum assisted post hole digger apparatus 21 is used according to the present invention. Handles 27 of post hole digger tool 20 are grasped in the left and right hands, respectively, of an operator A. The post hole digger tool 20 is then positioned vertically above a location in which a hole is to be dug, and the points of the cutting teeth 45 inserted into the soil, using a downward force exerted on the teeth by the weight of tool housing 27, and, if necessary, additional downward force exerted on handles 26 by the operator. A vacuum hose 4 is connected at one end to elbow 24, and at the other end to the improved vacuum source 1. Handles 26 are used to oscillate, toggle or rock housing 27 alternately in clockwise and counterclockwise directions relative to the longitudinal axis of the housing, in angular excursions of approximately 90-180 degrees clockwise and 90-180 degrees counterclockwise. This action causes cutting teeth 45 of severed soil. Negative pressure within bore 81 of tubular housing 27 and bore 42B of bore head 42 causes severed soil to be drawn up through the bore 81 of tool housing 27 thus facilitating rapid downward vertical digging motion.

The location of cutting teeth 45 on the outer cylindrical wall surface of base ring 43 forms a longitudinally disposed, annular arc-shaped gap between circumferentially spaced apart longitudinal edges of each pair of adjacent teeth. These gaps enable free flow of severed soil from the bore hole into the bore 81 of housing 27, thus minimizing the possibility of forming a vacuum blockage of bore 81, which would require withdrawing the housing vertically upwards in a bore hole being formed to clear the vacuum blockage.

Figure 12:
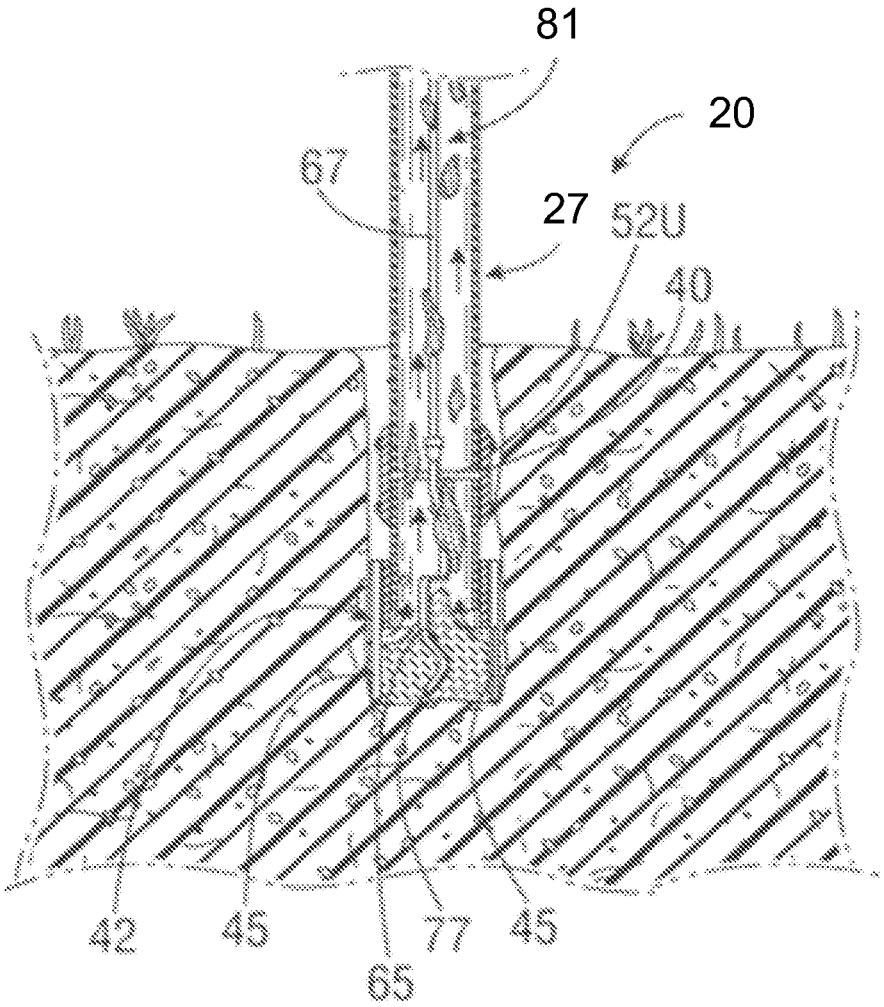
FIG. 12 shows the bore head in soil.

FIG. 12 illustrates how post hole digger 20 is used to dig holes in wet or clay bearing soil. The positioning of tool 20 relative to a ground surface of wet soil in which a hole is to be dug is similar to that in using the tool to dig a hole in dry soil. Moreover, the toggling or pivoting of the housing 27 of the tool 20, and general procedure for using the tool, are similar for both dry and wet soil. However when the bore 81 of tool housing 27 tends to become clogged because of wet, muddy or clay soil lodging within the bore, the upper end of stirrer rod drive shaft 67 that protrudes upwardly from vacuum inlet coupler elbow 24 is connected to a rotary power source, such as by clamping the end of the drive shaft in the chuck C of an electric drill B. The rotary power source is then energized, causing the zig-zag shaped mud and clay unclogger bar 65 located at the bottom end of rotating drive shaft 67 to slice through and pulverize mud clogs and clay, thus restoring efficient vacuuming of dirt and mud or clay through the bore 81 of tool housing 27.

Figure 13:
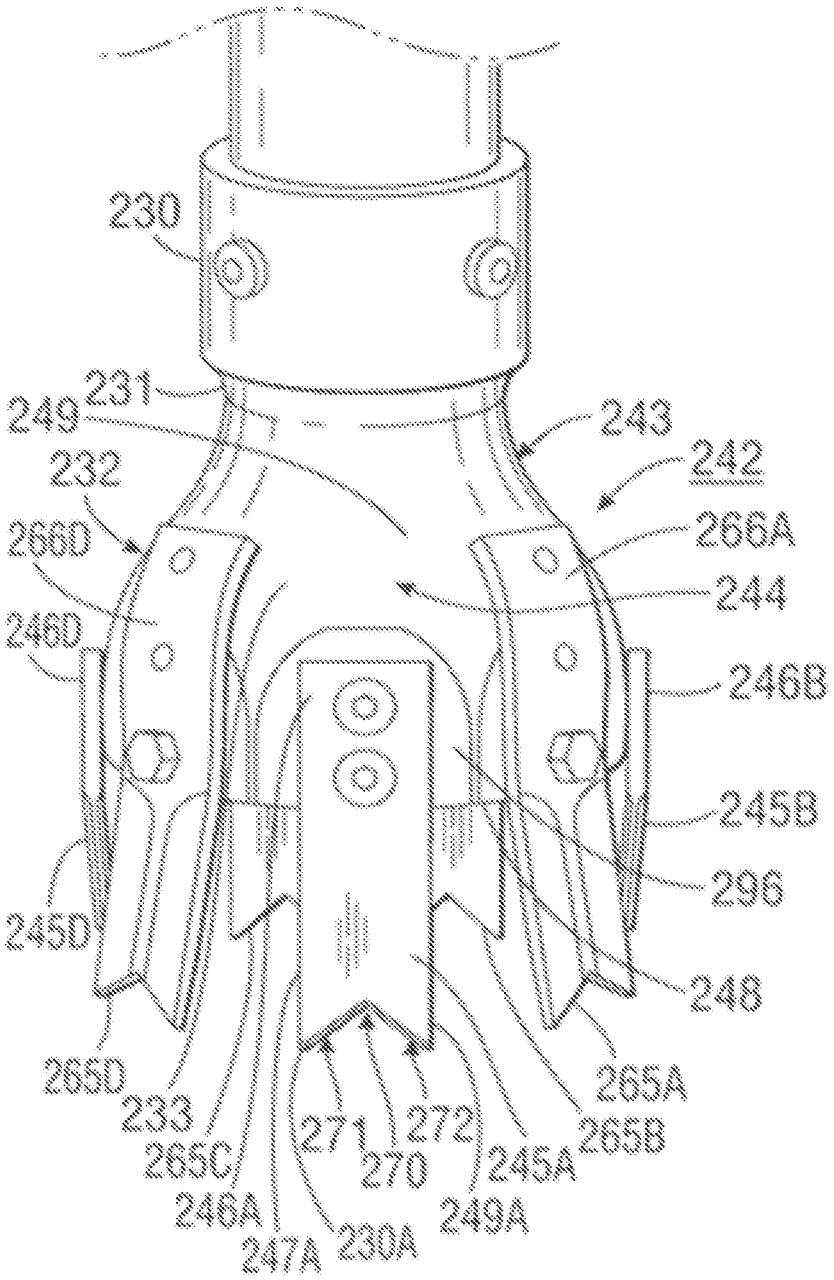
FIG. 13 shows a detailed view of an alternative embodiment of the bore head.

FIG. 13 illustrates a modified bore head 242 for use with the vacuum assisted post hole digger tools 20. Modified bore head 242 has a longitudinally elongated circular cross-section, hollow tubular teeth-anchor body 243. Teeth anchor body 243 has an elongated upper elongated cylindrically-shaped connection tube section 230, which at a lower transverse end thereof tapers radially inwardly to a smaller diameter, short neck section 231. The lower end of neck section 231 tapers radially outwardly to a longer teeth support section 232 of larger diameter than both upper connection tube section 230 and intermediate neck section 231. Teeth support section 232 has a generally uniform wall thickness. Thus, a lower generally cylindrically-shaped section 233 of teeth support section 232 has a generally cylindrically-shaped bore 234 which at the upper end thereof tapers radially inwardly via an angled annular transition section 235 to join a cylindrical inner bore 236 which is disposed longitudinally through neck section 231 and upper connection tube section 230.

Bore head 242 has attached to the outer cylindrical wall surface 244 of lower tooth support section 232 thereof a plurality of cutting teeth, including a first set of four axial cutting teeth 245A, 245B, 245C, 245D, which are spaced circumferentially apart at 90-degree intervals. Axial cutting teeth 245 are approximately parallel to the longitudinal axis of cutting tooth anchor body 243. Each axial cutting tooth 245 has a short, rectangular bar-shaped, upper root section 246, which is fastened to a flat 296 to the outer cylindrical wall surface 244 of the lower tooth support section 232. It may be seen that bore head 242 also has attached to outer cylindrical wall surface 244 of the bore head a second set of four angled cutting teeth 265A, 265B, 265C, 265D, which are located circumferentially midway between each pair of axial cutting teeth 245, and hence are also spaced apart circumferentially at 90-degree intervals. Each angled cutting tooth 265 has a relatively long, radially inwardly bent upper root section 266, which is fastened to both a flat 296 of the lower part of outer cylindrical wall surface 244 of lower tooth support section 232, at an intermediate longitudinal location of each tooth, and to an upper arcuately inwardly curved wall surface 297 of outer wall surface 298 of tooth support section 222 at an upper location of each tooth, each tooth having at an outer lateral edge thereof an acutely angled, wedge-shaped cutting point.

It may be seen that each cutting tooth 245, 265 has a similar symmetrical shape. Thus each cutting tooth 245, 246 has circumferentially spaced apart, longitudinally disposed straight, parallel left and right sides 247, 249 which are coextensive with left and right sides of upper tooth section 246 of each tooth. Each tooth 245, 265 has a lower transverse edge 250 which is spaced longitudinally below the lower transverse annular end wall 248 of lower tooth support section 232 of bore head 242. Lower transverse edge 250 has extending longitudinally upwards therein a symmetrically shaped notch 270 having the shape of an isosceles triangle, thus forming left 271 and right 272 cuspids of a bicuspid-shaped tooth, each having at an outer edge thereof an arcuately angled, wedge-shaped cutting point. Each tooth 245, 265 has in transverse section the shape of regular prism, including a central section having flat and parallel inner and outer longitudinally disposed rectangular sides 272, 273, and left and right triangular cross-section side section 274, 275, the outer longitudinally vertices 276, 277 of which form longitudinally disposed, wedge-shaped knife edges.

Figure 14:
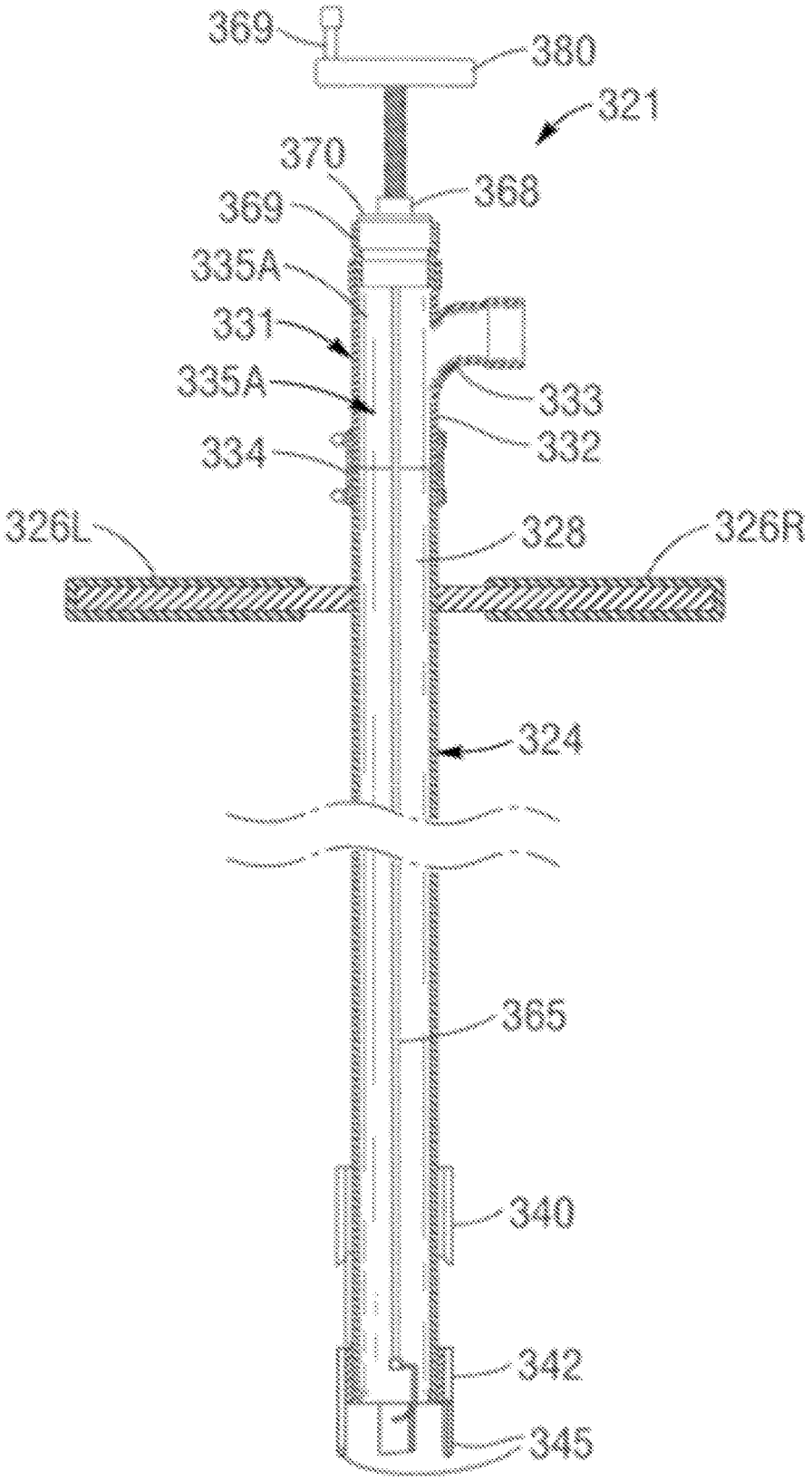
FIG. 14 shows the post hole digger tool with manual operation of the clogger bar.
Figure 15:
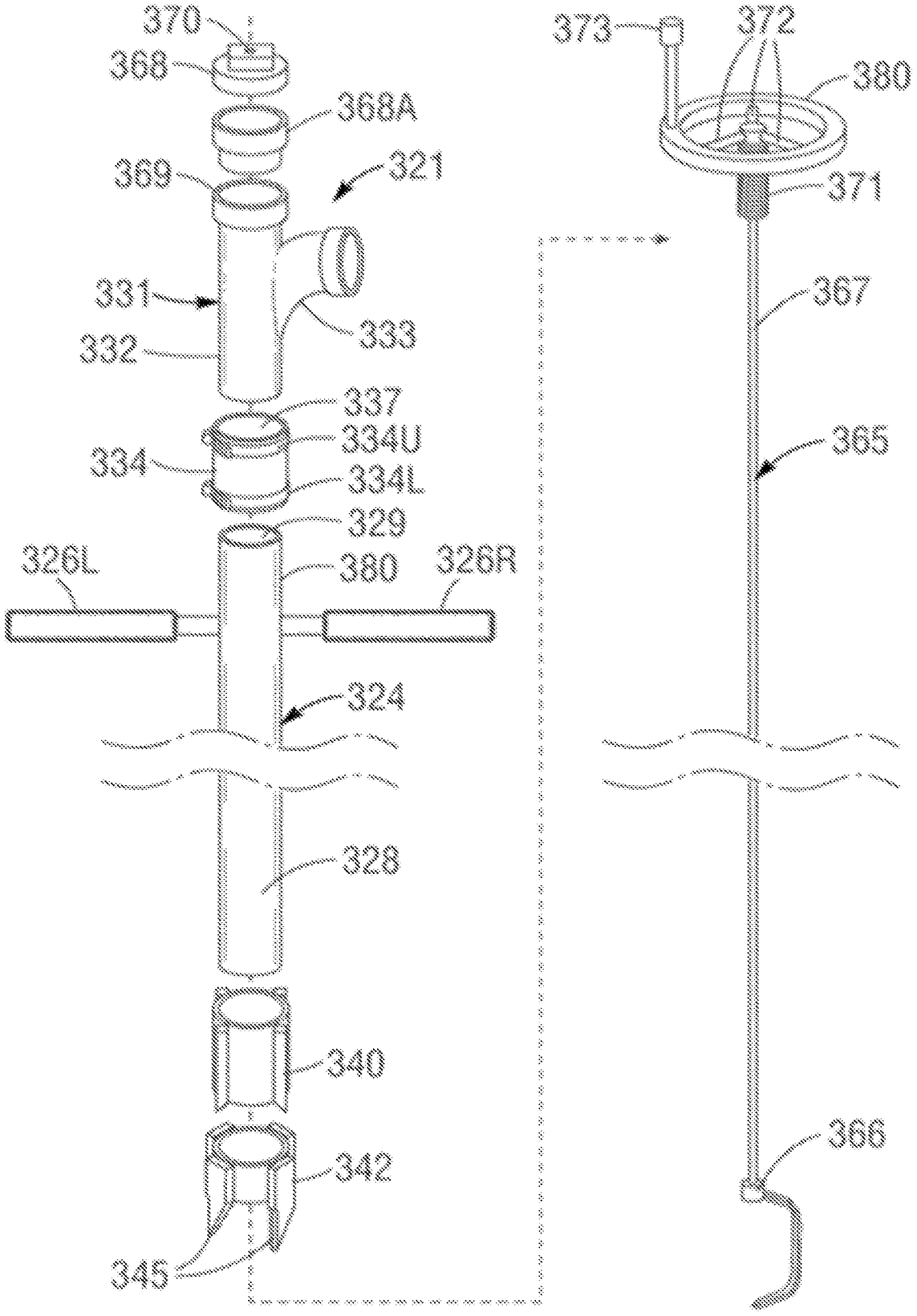
FIG. 15 shows an expanded view of the post hole digger tool with manual operation of the clogger bar.

FIGS. 14 and 15 illustrate a modification 321 of post hole digger tool 20 as described above. The construction and function of modified post hole digger 321 is substantially similar to that of tool 21 described above. Modified tool 321 has a modified mud and clay unclogger bar 365, which is fitted at the upper end thereof with a hand wheel 380 that enables the unclogger bar to be manually rotated, and also has a modified vacuum inlet tube 331. Modified vacuum inlet tube 331 has generally the shape of tubular Tee member which has a circular cross-section vertical in-line section 332, and a horizontal side tube section 333 which protrudes laterally outwards from a side of the vertical in-line section.

Tool 321 includes a tubular coupling clamp 334 for coaxially coupling the open lower end of the vertical in-line section 332 of vacuum inlet coupler Tee 331 in a vacuum-tight connection to the open upper end 329 of an elongated tubular tool housing 324, thus forming a smooth, hermetically sealed passageway between the elongated straight bore 328 of the tool housing 324 and the bore 335A through the vertical section 332 of the vacuum inlet Tee 331. Coupler 334 has through its length a longitudinally disposed circular cross-section bore 337 which has an upper opening that insertably receives the lower end of vertical in-line section 332 of inlet coupler Tee 331. Bore 337 of coupler 334 also has a lower opening which insertably receives the upper end of tool housing 324.

Tool 321 includes a pair of circular ring-shaped upper and lower hose clamps 334U, 334L which are tightenable onto the cylindrical outer wall surface of coupler 334 to secure the coupler to in-line section 332 of vacuum inlet coupler Tee 331 and tool housing 324. Optionally, coupler 334 may be replaced with a rotatable union type coupler of the type depicted in FIG. 10 and described above. Tool 321 includes an elongated longitudinally disposed rectangularly cross-section, zig-zag shaped unclogger bar 365 which is substantially similar in structure and function to unclogger bar 65 shown in FIG. 10.

Mud and clay unclogger bar 365 has an elongated drive shaft 367 which is disposed longitudinally upwards through the center of bore 328 through tool housing 324. The upper end of unclogger bar drive shaft 367 is rotatably mounted in the center of a bearing cap 368 which is joined by a stepped diameter cylindrical adapter coupling 368A to the upper opening of vertical in-line section 332 of vacuum inlet coupler Tee 331. Bearing 368 is coaxially aligned with the longitudinal center line of tool housing 324, and forms a vacuum-tight seal with upper end 369 of in-line section 332 of vacuum inlet coupler Tee 331. With this construction, air cannot leak from the exterior of the vacuum inlet coupler Tee 331 into the bore 335 through the Tee, when air pressure in the bore is reduced below ambient atmospheric pressure by coupling the side tube section 333 of the Tee to a vacuum source such as improved vacuum source 1, in the manner shown in FIG. 6.

It may be envisioned that the upper end of unclogger bar drive shaft 367 extends upwardly through a central coaxial bore 370 which is disposed through bearing cap 368. The upper end of the unclogger bar drive shaft has attached to its outer surface an enlarged diameter, elongated coaxial collar 371. Collar 371 is joined at its upper end to radial spokes 372 which are joined at the outer ends thereof to circular ring-shaped hand wheel 380. Hand wheel 380 has extending perpendicularly upwards from an upper surface thereof a crank handle 373, which may bed grasped in a person's hand and orbited by wrist motion to thus rotate hand wheel 380 and attached unclogger bar 365. Optionally, hand wheel 380 may be removably fastened to collar 371 so that the collar 371 at the upper end of the unclogger bar drive shaft 367 may be coupled to and rotatably driven by a motor 22 in the manner shown in FIG. 6.

Figure 16:
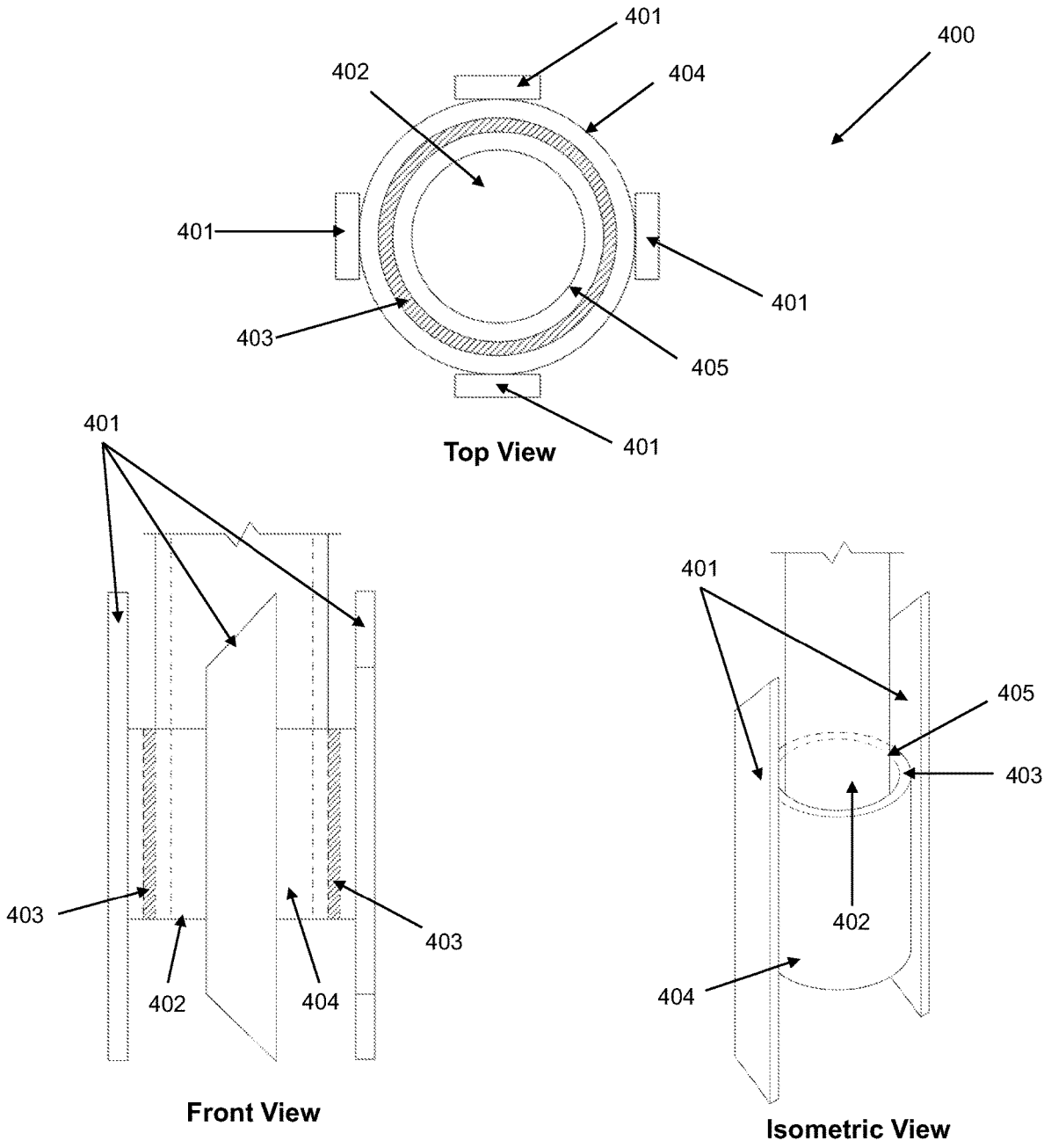
FIG. 16 shows a view of an air gap bore head.

FIG. 16 shows an alternate embodiment of air gap bore head 400 shown top, front and isometric views. This embodiment of air gap bore head 400 includes an air gap between the suction tube and the blades. This air gap provides an additional outlet for suction that helps prevent clogs of the suction tube. If the material clogs the suction tube, vacuum is still able to escape via the air gap so that suction continues through the tube. This suction provides air flow that assists the clog in breaking up. Rather than the vacuum clogging and no air flow occurring in the suction tube, in this embodiment, suction passes through the air gap as well, providing continuous air flow and less likelihood of clogging.

Air gap bore head 400 is comprised of cutting teeth 401. These cutting teeth 401 are similar to those described in other embodiments disclosed herein. Vacuum bore 402 is created by vacuum housing 405. Air gap 403 surrounds vacuum housing 405 and has a dimension of ⅛" in the preferred embodiment. Other air gap 403 dimensions are anticipated in alternate embodiments. Cutting teeth 401 are attached to blade housing 404 by welding or other suitable attachment means. Air gap bore head 400 is manufactured from materials similar to other bore heads disclosed herein.

The present figures and detailed description disclose the preferred embodiment of the claimed invention and are not meant to limit the scope of the claims. Many other configurations and embodiments are possible within the scope of the present claims.

The invention claimed is:

1. A system for boring holes in soil comprising:

A vacuum device for collecting material comprising:

A tank with vertical walls, a floor and an open top, the tank for collecting material collected by the vacuum device;

A lid comprising an upper surface, a lower surface, a first opening and a second opening, the lid sized to fit over the open top of the tank and form an airtight seal;

At least one latch for securely fastening the lid to the top of the tank;

A filter box comprising a first end and a second end, the filter box disposed on the upper surface of the lid and over the first opening in the lid, the first end of filter box arranged to form an airtight seal with the first opening of the lid and to be in fluid communication with the tank, the filter box further including an air filter disposed to filter material greater than a specific size traveling from the first end to the second end of the filter box;

A vacuum junction having a first connection, a second connection and a third connection, said vacuum junction being disposed at the second end of the filter box and the first connection arranged to have an airtight seal with the second end of the filter box and fluid communication with the filter box;

A first vacuum hose, having an input end and an output end, the output end connected with an airtight seal and in fluid communication with the second connection of the vacuum junction;

A second vacuum hose, having an input end and an output end, the output end connected with an airtight seal and in fluid communication with the third connection of the vacuum junction;

A first vacuum motor having a suction output and an exhaust output;

A second vacuum motor having a suction output and an exhaust output;

The suction output of the first vacuum motor being attached with an airtight seal and in fluid connection with the input end of the first vacuum hose;

The suction output of the second vacuum motor being attached with an airtight seal and in fluid connection with the input end of the second vacuum hose;

A main suction hose having a first end and a second end, the first end being connected with an airtight connection with the second opening of the lid, and in fluid communication with the tank and the second end being utilized to collect material with suction;

A tool for boring holes in soil comprising;

a longitudinally elongated tubular housing having disposed through its length a vacuum bore, said housing having at an upper end thereof an upper opening which communicates with said bore, and is connectable to the vacuum device, and said housing having at a lower end thereof a lower opening which communicates with said vacuum bore, a bore head assembly fastened to a lower end of said housing, said bore head assembly including at a lower end thereof a structure for severing soil, said bore head assembly having disposed longitudinally therethrough a central coaxial bore which has an open lower end and communicates at an upper end thereof with said vacuum bore through said housing, a vacuum inlet tube having an inner leg connectable to said upper opening of said housing and an outer leg connectable to the vacuum device, and a vacuum-tight rotatable union which joins said inner leg of said vacuum inlet tube to said tubular housing.

2. The system for boring holes in soil of claim 1 further comprising;

An opening at the upper end of the tubular housing;

A longitudinally elongated soil breaking device, having a first end and a second end, disposed through the center of the housing and through the central coaxial bore of the bore head assembly;

The first end of the soil breaking device being disposed to activate the soil breaking device and disposed through the opening at the upper end of the tubular housing, the opening having an airtight seal around the first end of the soil breaking device;

The second end of the soil breaking device being disposed to contact the soil at the center of the bore head.

3. The system for boring holes in soil of claim 2 further comprising;

A handle at the first end of the soil breaking device for providing rotating the soil breaking device.

4. The system for boring holes in soil of claim 2 further comprising;

The second end of the soil breaking device having a point.

5. The system for boring holes in soil of claim 2 further comprising;

The second end of the soil breaking device having a zig zag shape.

6. The system for boring holes in soil of claim 2 further comprising;

A pad at the first end of the soil breaking device for applying vertical force.

7. The system for boring holes in soil of claim 2 further comprising;

A motor disposed at the first end of the social breaking device for providing rotational energy to the device.

8. A system for boring holes in soil comprising;

A vacuum device for collecting material comprising:

A tank with vertical walls, a floor and an open top, the tank for collecting material collected by the vacuum device;

A lid comprising an upper surface, a lower surface, a first opening and a second opening, the lid sized to fit over the open top of the tank and form an airtight seal;

At least one latch for securely fastening the lid to the top of the tank;

A filter box comprising a first end and a second end, the filter box disposed on the upper surface of the lid and over the first opening in the lid, the first end of filter box arranged to form an airtight seal with the first opening of the lid and to be in fluid communication with the tank, the filter box further including an air filter disposed to filter material greater than a specific size traveling from the first end to the second end of the filter box;

A vacuum junction having a first connection, a second connection and a third connection, said vacuum junction being disposed at the second end of the filter box and the first connection arranged to have an airtight seal with the second end of the filter box and fluid communication with the filter box;

A first vacuum hose, having an input end and an output end, the output end connected with an airtight seal and in fluid communication with the second connection of the vacuum junction;

A second vacuum hose, having an input end and an output end, the output end connected with an airtight seal and in fluid communication with the third connection of the vacuum junction;

A first vacuum motor having a suction output and an exhaust output;

A second vacuum motor having a suction output and an exhaust output;

The suction output of the first vacuum motor being attached with an airtight seal and in fluid connection with the input end of the first vacuum hose;

The suction output of the second vacuum motor being attached with an airtight seal and in fluid connection with the input end of the second vacuum hose;

A main suction hose having a first end and a second end, the first end being connected with an airtight connection with the second opening of the lid, and in fluid communication with the tank and the second end being utilized to collect material with suction;

A tool for boring holes in soil comprising;

a longitudinally elongated tubular housing having disposed through its length a vacuum bore, said housing having at an upper end thereof an upper opening which communicates with said bore, and is connectable to the vacuum device, and said housing having at a lower end thereof a lower opening which communicates with said vacuum bore, a bore head assembly disposed at the lower end of said housing, said bore head assembly including at a lower end thereof a structure for severing soil, said bore head assembly having disposed longitudinally therethrough a central coaxial bore which has an open lower end and communicates at an upper end thereof with said vacuum bore through said housing, a vacuum inlet tube having an inner leg connectable to said upper opening of said housing and an outer leg connectable to the vacuum device, a vacuum-tight rotatable union which joins said inner leg of said vacuum inlet tube to said tubular housing, Said bore head assembly being formed of an elongated tubular material with a greater circumference than that of the housing;

The bore head being fitted over and attached to the housing;

The vacuum bore communicating through the length of the housing and above the lower end of the bore head assembly, The bore head assembly installed so that its lower end is below the end of the housing and vacuum bore; and At the upper end of the bore head, an air gap is provided between the bore head and the housing.

9. The system for boring holes in soil of claim 8 further comprising;

An opening at the upper end of the tubular housing;

A longitudinally elongated soil breaking device, having a first end and a second end, disposed through the center of the housing and through the central coaxial bore of the bore head assembly;

The first end of the soil breaking device being disposed to activate the soil breaking device and disposed through the opening at the upper end of the tubular housing, the opening having an airtight seal around the first end of the soil breaking device;

The second end of the soil breaking device being disposed to contact the soil at the center of the bore head.

10. The system for boring holes in soil of claim 9 further comprising;

A handle at the first end of the soil breaking device for providing rotating the soil breaking device.

11. The system for boring holes in soil of claim 9 further comprising;

The second end of the soil breaking device having a point.

12. The system for boring holes in soil of claim 9 further comprising;

The second end of the soil breaking device having a zig zag shape.

13. The system for boring holes in soil of claim 9 further comprising;

A pad at the first end of the soil breaking device for applying vertical force.

14. The system for boring holes in soil of claim 9 further comprising;

A motor disposed at the first end of the social breaking device for providing rotational energy to the device.

* * * * *